US009579666B2

(12) United States Patent
Mangadoddy et al.

(10) Patent No.: US 9,579,666 B2
(45) Date of Patent: Feb. 28, 2017

(54) CYCLONE FOR DENSE MEDIUM SEPARATION

(75) Inventors: Narasimha Mangadoddy, Jamshedpur (IN); Pradip Kumar Banerjee, Jamshedpur (IN); Debashish Bhattacharjee, Jamshedpur (IN); T. Mukherjee, Jamshedpur (IN); Peter Holtham, Brisbane (AU); Matthew Brennan, Brisbane (AU)

(73) Assignee: Tata Steel Limited, Jamshedpur (IN)

( * ) Notice: Subject to any disclaimer, the term of this patent is extended or adjusted under 35 U.S.C. 154(b) by 459 days.

(21) Appl. No.: 12/673,920

(22) PCT Filed: Dec. 18, 2007

(86) PCT No.: PCT/IN2007/000584
§ 371 (c)(1),
(2), (4) Date: Sep. 8, 2010

(87) PCT Pub. No.: WO2009/022353
PCT Pub. Date: Feb. 19, 2009

(65) Prior Publication Data

US 2010/0326895 A1 Dec. 30, 2010

(30) Foreign Application Priority Data

Aug. 16, 2007 (IN) ..... 1134/KOL/07

(51) Int. Cl.

| | |
|---|---|
| ***B07B 7/00*** | (2006.01) |
| ***B07B 7/04*** | (2006.01) |
| ***B04C 5/04*** | (2006.01) |
| ***B03B 5/34*** | (2006.01) |
| ***B04C 5/081*** | (2006.01) |
| ***B04C 5/13*** | (2006.01) |

(52) U.S. Cl.
CPC . *B04C 5/04* (2013.01); *B03B 5/34* (2013.01); *B04C 5/081* (2013.01); *B04C 5/13* (2013.01)

(58) Field of Classification Search
CPC ..... B03B 5/34; B04C 5/04; B01D 21/26
USPC ..... 209/138, 139.1, 139.2, 143, 710, 717,209/718, 722, 154
See application file for complete search history.

(56) References Cited

U.S. PATENT DOCUMENTS 3,105,044 A * 9/1963 Troland ..... 210/512.1
3,235,090 A * 2/1966 Bose et al. ..... 210/512.1
(Continued)

FOREIGN PATENT DOCUMENTS

DE 3440108 A1 5/1986
DE 3741753 A1 7/1988

*Primary Examiner* — Michael McCullough
*Assistant Examiner* — Michael E Butler
(74) *Attorney, Agent, or Firm* — The Webb Law Firm

(57) ABSTRACT

This invention relates to a cyclone for dense medium separation that includes an inverted conical shaped cyclone body which provides an interior space having an inner wall surface a vortex finder including a lower end that extends longitudinally into an upper region of the interior space of the cyclone body an overflow outlet associated with an upper end of the vortex finder a feed inlet that is in fluid communication with the upper region of the interior space of the cyclone body an outlet associated with a lower region of the interior space and the inner wall surface of the interior space curves inwardly and downwardly from the upper region curves inwardly and downwardly from the upper region of the interior space to the lower region of the interior space.

11 Claims, 6 Drawing Sheets

(56) References Cited

U.S. PATENT DOCUMENTS

| | | | | | |
|---|---|---|---|---|---|
| 3,337,050 | A | * | 8/1967 | Labecki | 209/731 |
| 3,766,661 | A | * | 10/1973 | Bayens et al. | 34/371 |
| 4,219,409 | A | * | 8/1980 | Liller | 209/13 |
| 4,224,143 | A | * | 9/1980 | Liller | 209/727 |
| 4,317,716 | A | * | 3/1982 | Liller | 209/732 |
| 4,354,552 | A | * | 10/1982 | Zingg | 166/90.1 |
| 4,378,289 | A | * | 3/1983 | Hunter | 209/722 |
| 4,394,349 | A | * | 7/1983 | Cartmell | 422/147 |
| 4,578,199 | A | * | 3/1986 | Peel et al. | 210/788 |
| 4,603,661 | A | * | 8/1986 | Nelson et al. | 122/392 |
| 4,670,161 | A | * | 6/1987 | Hayatdavoudi | 210/739 |
| 4,718,923 | A | * | 1/1988 | Haag et al. | 96/56 |
| 4,842,145 | A | * | 6/1989 | Boadway | 209/719 |
| 4,865,633 | A | * | 9/1989 | Stevenson | 55/459.1 |
| 5,071,557 | A | * | 12/1991 | Schubert et al. | 210/512.2 |
| 5,110,471 | A | * | 5/1992 | Kalnins | 210/512.2 |
| 5,192,423 | A | * | 3/1993 | Duczmal et al. | 209/164 |
| 5,294,061 | A | * | 3/1994 | van Dijk | 241/23 |
| 5,340,481 | A | | 8/1994 | Mullins | |
| 5,562,806 | A | * | 10/1996 | Abdulmassih et al. | 162/261 |
| 5,566,835 | A | * | 10/1996 | Grimes | 210/512.1 |
| 5,775,446 | A | * | 7/1998 | Lott | 175/424 |
| 6,024,874 | A | * | 2/2000 | Lott | 210/512.1 |
| 6,146,525 | A | * | 11/2000 | Li et al. | 210/221.2 |
| 6,482,246 | B1 | * | 11/2002 | Dyson et al. | 55/459.1 |
| 6,530,484 | B1 | * | 3/2003 | Bosman | 210/512.1 |
| 6,596,169 | B1 | * | 7/2003 | Rong et al. | 210/512.1 |
| 6,997,973 | B2 | * | 2/2006 | Kilgore | 95/271 |
| 8,052,778 | B2 | * | 11/2011 | McFarland et al. | 95/219 |
| 2003/0112998 | A1 | * | 6/2003 | Rhoads | 382/100 |
| 2004/0142078 | A1 | * | 7/2004 | Eichner | 426/466 |
| 2005/0000200 | A1 | * | 1/2005 | Christiansen et al. | 55/456 |
| 2005/0229780 | A1 | * | 10/2005 | Spink et al. | 95/65 |
| 2006/0175123 | A1 | * | 8/2006 | Yabe et al. | 180/444 |
| 2007/0131594 | A1 | * | 6/2007 | Hakola | 209/715 |
| 2009/0145813 | A1 | * | 6/2009 | Kim et al. | 209/13 |
| 2009/0294384 | A1 | * | 12/2009 | Kruyer | 210/788 |

* cited by examiner

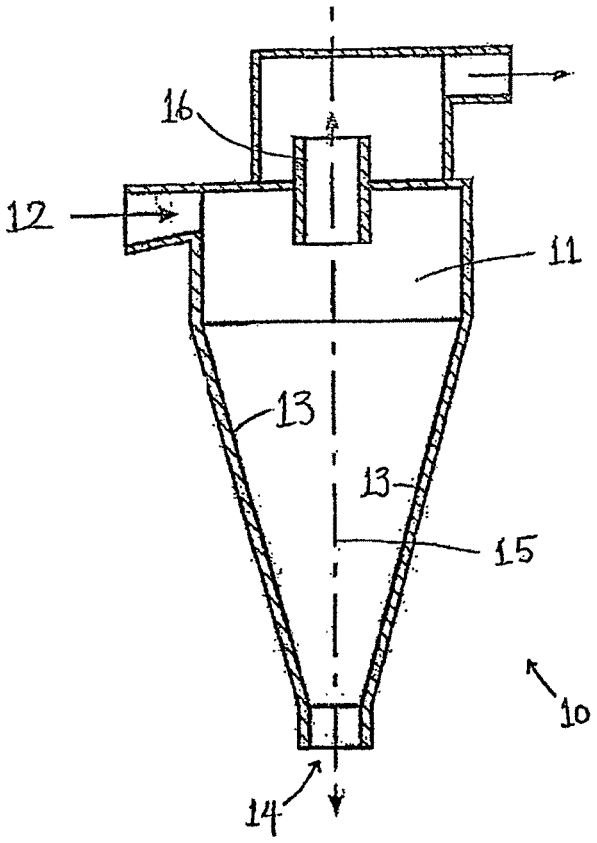
FIGURE 1 - PRIOR ART

CYCLONE FOR DENSE MEDIUM SEPARATION

FIELD OF THE INVENTION

The present invention relates to a cyclone for dense medium separation adaptable to be used in the dense medium separation of a fine coal (−2+0.25 mm) fraction. More particularly, the invention relates to a cyclone for dense medium separation that has been developed to minimize turbulence within the cyclone during the separation process.

BACKGROUND OF THE INVENTION

The flow behaviour of slurries within cyclones is quite complex. This has led designers to rely on empirical equations for predicting performance of cyclones. These empirical relationships are derived from an analysis of experimental data and include the effect of operational and geometric variables. Different sets of experimental data lead to different equations for the same basic parameters. However, these empirical models suffer from the inherent deficiency of any empirical model. That is, the model can only be used within the limits of the experimental data from which the model parameters were determined. In view of this shortcoming, mathematical models based on fluid mechanics are highly desirable.

The numerical technique "Computational Fluid Dynamics (CFD)" herein means the numerical treatment of the Navier-Stokes equations over a structured/unstructured 3D grid within a cyclone body. Turbulence modeling is achieved by both RSM (Reynolds Stress Model) and LES (Large Eddy Simulations) in order to capture the high swirling flow patterns seen in dense medium cyclones. CFD provides a means of predicting velocity profiles under a wide range of development and operating condition. The numerical treatment of the Navier-Stokes equations, the basic of any CFD technique, crept into the analysis of cyclone behaviour in the early 1980s. This resulted from the rapid Improvement in computers at that time and a better understanding of the numerical treatment of turbulence.

The expression "fine coal dense medium separation process" herein means separation of a fine coal material into dense and less high gravity fraction at a predetermined cut point. In the process the particulate material is carried in a dense liquid medium which typically comprises a mixture of water and particles of dense material such as ultra fine magnetite.

At present, the dense medium cyclone (DMC) is one of the best pieces of processing equipment for washing coal of −20+0.5 mm size. Difficult washing characteristics associated with, for example, many Indian coals are generally due to the present of a high proportion of near-gravity material (NGM). This makes the DFC an obvious choice for most Indian washers. In order to produce low ash clean coal from run-of-mine (ROM) coal, it is necessary to crush the ROM to fine sizes to liberate ash & coal. One of the more efficient methods of beneficiating the generated intermediate size fraction (−2+0.25 mm) fines is dense medium operation is small diameter cyclones.

A known prior art dense medium cyclone is illustrated in FIG. 1. This conventional dense medium cyclone 10 includes a cylindrical inlet chamber 11 into which a mixture of medium and raw coal enters tangentially through an inlet 12, thus forming a strong vertical flow. The refuse or high ash particles move along the wall 13 of the cyclone due to the centrifugal force, where the velocity is the least and is discharged through the underflow orifice 14 or spigot. The lighter washer coal moves towards the longitudinal axis 15 of the cyclone due to the drag force where a high velocity zone exists and passes through an overflow orifice or vortex finder 16, also sometimes termed an overflow chamber. With cyclone of this type, entrainment of fine or slower settling particles occurs in the void spaces between the coarser, or faster settling, particles discharged as the underflow. Turbulence fluctuation inside the cyclone are also expected to be significant due to the collision of the inlet stream with the rotating stream. Due to inadequate standard inlet and body section design, these cyclones are associated with large short-circuit flow and short residence time of the internal upward flow. The through put and performance is limited by the flow through the axial outlet. For many applications therefore, cyclones of this type are operated at a reduced feed rate, in order to obtain the required cut between the low gravity fraction and high gravity fraction.

There us need to develop a new design for a DMC for the recovery of clean coal ash (<8%) from high NGM coals, such as those seen in India. It would be particularly advantageous if a dense medium cyclone having increased efficiency could be devised that is able to produce a product with reduced ash content. It would also be advantageous if a dense medium cyclone could be devised having an increased ability to separate out fine particles efficiently.

A new improved development of DMC for efficient coal separation emphasizing a fines fraction of −2+0.25 mm has been development using a comprehensive CFD model. In particular, a CFD model of the DMC which is capable of predicting the performance of the cyclone has been developed, using Fluent, by coupling component models for the air-core, the magnetite medium Lagrangian particle tracking for particles ranging in size from 0.25 to 2 mm. This has resulted in the invention described below.

OBJECTS OF THE INVENTION

It is therefore, an object of the present invention to propose CFD cyclone for dense medium separation of a fine coal, which eliminates the disadvantages of prior Art.

Another objection of the present invention is to propose CFD cyclone for dense medium separation of a fine coal, which is capable of predicting the performance of a cyclone and has been developed using fluent by coupling component models for the air-core, the magnetite medium and coal particles.

A further object of the present invention is to propose CFD cyclone for dense medium separation of a fine coal, which separates fine coal particles by enhancing residence time of fine coal particles and minimising recirculation zone inside the cyclone.

A still further object of the present invention is to propose CFD cyclone for dense medium separation of a fine coal, which minimizes short-circuiting and recirculation zones inside the cyclone.

SUMMARY OF THE INVENTION

The present invention advantageously provides am improve dense medium cyclone model which it is believed will exhibit an improved throughput relative to conventional cyclones for fine coal beneficiation.

According to one aspect of the invention there is provided a cyclone for dense medium separation including.

a cyclone body that defines an interior space having an inner wall surface;

a vortex finder including a lower end that extends longitudinally into upper region of the interior space of the cyclone body;

region of the interior space of the cyclone body;

an overflow outlet associated with an upper end of the vortex finder;

a feed inlet that is in fluid communication with the upper region of the interior space of the cyclone body; and an outlet associated with a lower region of the interior space;

wherein the inner wall surface of the interior space curves inwardly and downwardly from the upper region of the interior space to the lower region of the interior space.

According to CFD predictions, in conventional dense medium cyclone (as illustrated in FIG. 1) a very high turbulent kinetic energy exists near the tip of vortex finer. As expected, the sudden transition from a cylindrical section to a conical section result In a clear source of turbulent fluctuations downwards through the cyclone body. These fluctuations usually propagate a very high turbulent kinetic energy near the bottom of the apex zone. Modifying the cylindrical-conical shape of the conventional DMC to a rounded wall design as described in the immediately preceding paragraph advantageously alleviates or avoids turbulent fluctuations due to separation at the intersection of cylindrical conical sections. Further, throughput in the design of the invention is advantageously high compared to the conventional cyclones described above.

Furthermore, it is anticipated that the rounded wall design may significantly increase the residence time of fine particles within the cyclone which would be advantageous as would be appreciated by those in the art.

The curvature of the inner wall surface of the interior space preferable extends substantially along the longitudinal length of the cyclone body. More particularly, in a preferred embodiment the degree of curvature of the inner wall surface of the interior space in longitudinal direction continuously increases from a lower end of the vortex finder to the lower region of the interior space. More preferable the associated with the lower region of the interior space.

The degree of curvature of the inner wall surface is not particularly limited and may vary from case to case. However, in a particular embodiment, the curvature of the inner surface of the interior space increase from about 1 degree at the point immediately below the feed inlet to about 20 degree at the outlet.

According to a particular embodiment of the invention, the vortex finder is provided with an outer surface that tapers outwardly and downwardly into the upper region of the interior space along the longitudinal axis of the cyclone body.

The degree of the taper of the outer surface of the vortex finder according to this embodiment of the invention is not particularly limited. However, it is preferred that the outer surface of the vortex finder tapers outwardly and downwardly at 9 degree from the longitudinally axis of the cyclone body.

The overflow outlet may be positioned as desired relative to the lower end thereof that extends longitudinally into the upper region of the interior space of the cyclone body.

Generally it is prepared that the overflow outlet is disposed on the upper end of the vortex finder and in alignment with the longitudinal axis of the cyclone body.

The feed inlet may take any suitable configuration. In a preferred embodiment, however, the feed inlet includes an involute conduit that extends around a portion of the circumference of an upper end of the cyclone body. More particularly, the involute conduit preferable extends horizontally along the circumference of the upper end of the cyclone body and includes a rear wall that curves inwardly and that is coterminous with an inner wall surface of the upper end of the cyclone body.

The upper region of the interior space may be in the form of substantially cylindrical barrel that extends up to 1.23 Dc from the top of the cyclone body, compared to 0.67 Dc in conventional cyclones. The substantially cylindrical barrel merges with and into the more rounded inner wall surface of the interior space of the cyclone for handling higher throughputs compared with conventional cyclones. The overall length of the cyclone is generally about 3.23-3.5 Dc which is effectively 1.23 m for a 350 mm cyclone is generally about 3.23-3.5 Dc which is effectively 1.23 m for a 350 mm cyclone.

The improved inlet design described above, including the preferred form for the vortex finder and the preferred form for the feed inlet, advantageously makes it conceptually possible to minimize short-circuiting of the high gravity fraction into the overflow. Further, this design advantageously provides high centrifugal forces in the upper region of the interior space of the cyclone body.

BRIEF DESCRIPTION OF ACCOMPANYING DRAWINGS

FIG. 1 is schematic cross section view of a DSM dense medium cyclone which is known in the art;

DETAILED DESCRIPTION OF A PREFERRED EMBODIMENT OF THE INVENTION

Figure 2A:
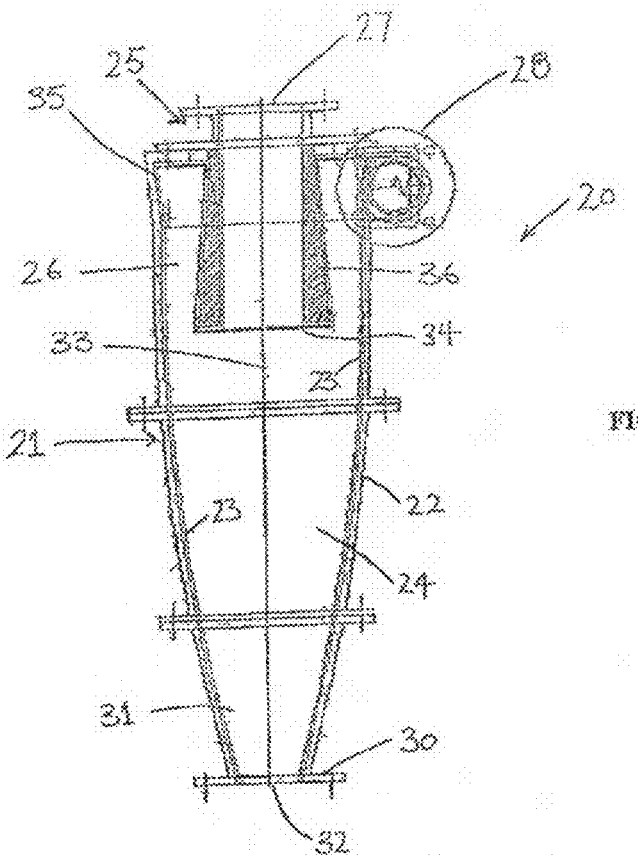
FIGS. 2A and 2B are schematic cross sectional views of a dense medium cyclone in accordance with the invention.
Figure 2B:
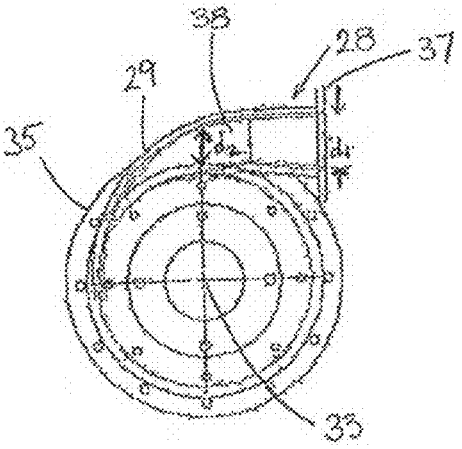
Figure 3:
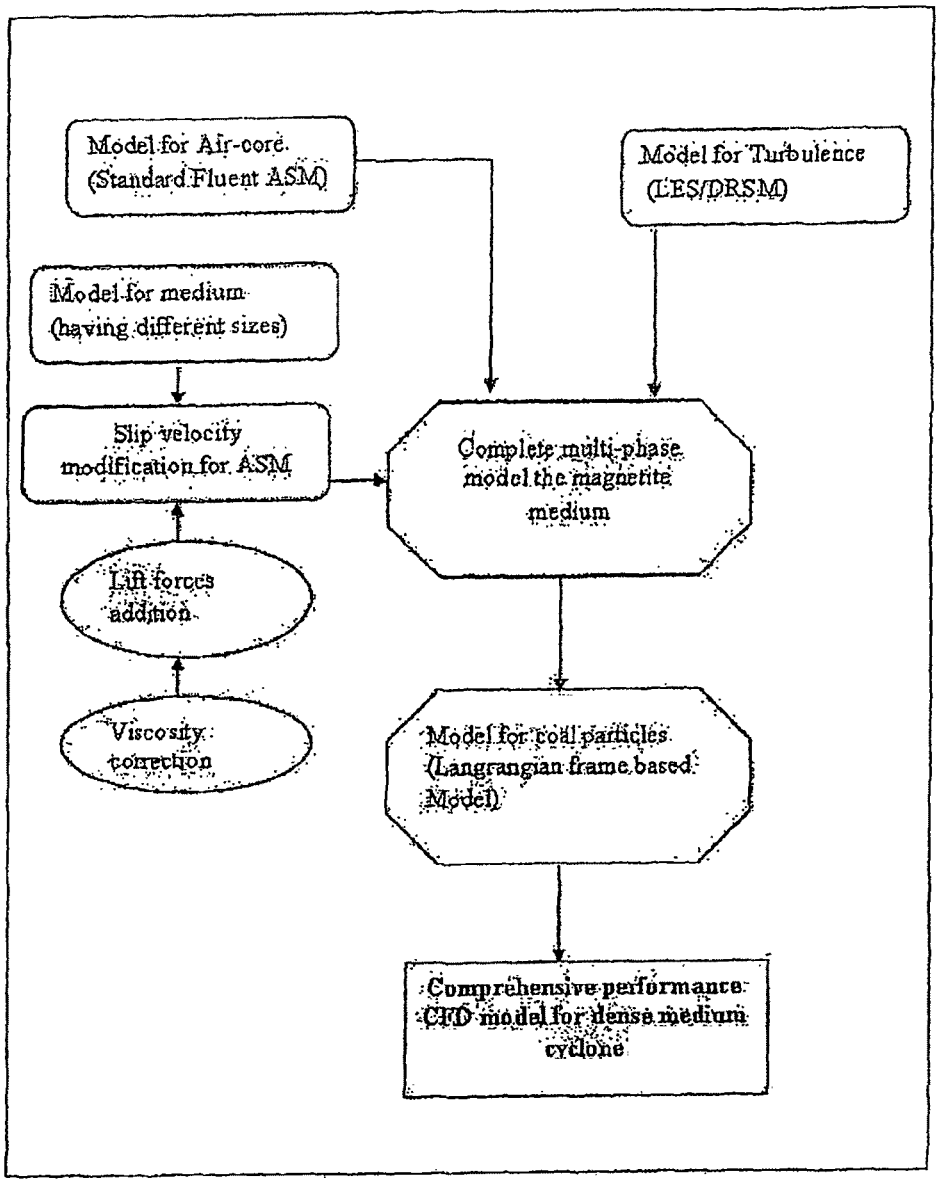
FIG. 3 is a schematic view of the methodology of the developed CFD model used to predict the performance of dense medium cyclones.

Referring to FIGS. 2A and 2B, a cyclone 20 is illustrated that includes a cyclone body 21 define by a cyclone body wall 22. The cyclone body wall 22 has an inner wall surface 23 that defines an interior space 24 within which the separation process takes place.

A vortex finder 25 extends into an upper region 26 of the interior space 24 of the cyclone body 21. The vortex finder 25 is axially orientated and includes an overflow outlet 27 that is associated with its upper end.

A feed inlet 28 is provided that is in fluid communication with the region 26 of the interior space 24. The feed inlet is involute, as best seen in FIG. 2B, in that wall 29 of the feed inlet 28 is curved and coterminous with the inner wall surface 23 at an upper end 35 of the cyclone body 21. The feed inlet 28 provides a means for the introduction of a fluid stream into the interior space 26 and will be discussed in more detail below. A spigot 30 in provided in a lower region 31 of the interior space 24 and provides an axially directed outlet 32 for removing fluid and high density material from the cyclone body 21. The diameter of the spigot 30 of the lower 31 may be determined using the application of normal cyclone design criteria.

The inner wall surface 23 of the cyclone body wall 22 curves inwardly and downwardly substantially along the length of the cyclone body 21. The inner wall surface 23 typically curves inwardly downwardly from the bottom of the feed inlet 28 to the spigot 30 at a continuously changing cone angle of from 1° to 20° relative to the longitudinal axis 33 of the cyclone body 21. The converging rounded nature of the inner wall surface 23 is though to be important in generating appropriate helical fluid flow pattern through the interior space 24 of the cyclone body 21 to achieve a desired degree of separation.

The smaller angles in the upper region 26 of the interior 24 are thought to be important when dealing with separation involving fine particles, for example of less that 2 mm. Angles of close to 20° near the spigot 30 in the lower region 31 of the interior space 24 are thought to avoid surging if any occurs, at high throughput rates.

It is believed that the design of the invention will therefore permit a greater volume of high gravity fraction to pass through the outlet 32 compared with conventional cyclones as briefly described above.

As noted above, the vortex finder 25 extends substantially axially into the upper region 26 of the interior space 24 of the cyclone body 21. The vortex finder 25 defines an overflow outlet 27 which removes fluid and entrained particles from the cyclone. The vortex finder 25 terminates with an internal end 34 which is positioned at least a minimum distance below the feed inlet 28 of the cyclone 20. The upper region 26 of the interior space 24 defined between the inner wall surface 23 at the upper end 35 of the cyclone body 21 and the vortex finder 25 forms a feed zone of the cyclone 20.

Referring to the feed zone of the cyclone 20, the inner wall surface 23 at the upper end 35 of the cyclone body 21 extending from the top of the cyclone body 21 to the just below the feed inlet 28 tapers inwardly and downwardly at an angle of typically 6°. The vortex finder 25 includes an outer wall 36 that tapers outwardly and downwardly towards its internal end 34. The illustrated vortex finder 7 tapers outwardly towards at an angle of 9° relative to a longitudinal axis of the cyclone body 21.

The combination of inward taper of the inner wall surface 23 at the upper end 35 of the cyclone body 21, a curved portion of the inner wall 36 of the vortex finder 25 creates a feed zone of decreasing cross section area from the feed inlet 28 down to the internal end 34 of the vortex finder 25. This has the effect of accelerating the fluid and entrained medium and coal particles through this region, thereby increasing centrifugal forces. Furthermore, the outer wall 36 of the vortex finder 25 is spaced a reasonable distance radially outwardly relative to the overflow outlet 27 of the vortex finder 25. This also has the effect of decreasing the cross sectional area of the feed zone for fluid flow between the inner wall surface 23 and the outer wall 36 of the vortex finder 25.

The feed inlet 28, in more detail, includes an aperture through which feed is introduced and an involute conduit 38 that extends around a portion of the upper end 35 of the cyclone body 21. The involute conduit 38, at its outer wall 29, tapers inwardly as is shown in the drawings. Again, this has the effect of accelerating the feed as it centers the cyclone body 21.

Generally, the ratio of diameters $d_1$:$d_2$ is about 2.25. It will be appreciated, however, that the size and configuration of the inlet conduit 38 and associated conduit opening 37 may typically be determined depending on the application on the application to which the cyclone is being put according to tradition design criteria.

In use, a fluid stream containing entrained coal particles enters via the opening 37 of the inlet 28 under pressure and flows helically down the cyclone body 21 towards the underflow outlet 32. The acceleration of the fluid and entrained coal particles through the feed zone acts to reduce short circuiting flow direct to the overflow outlet 27.

The rapid swirling flow of the fluid has the effect of displacing relatively heavier particles towards radially outer positions in the interior space 24 of the cyclone body 21, proximate to the cyclone body wall 22. Relatively lighter particles are displaced to a radially inner position in the interior space 24. As a result, the heavier particles tend to exit the cyclone via the underflow outlet 32.

A rapidly swirling core of air moves upwardly from the underflow outlet 32 through a central region of the interior space 24 towards the vortex finder 25 where it exits via the overflow outlet 27. This swirling core of air which very unstable carries with it the relatively lighter particles.

The medium used for the dense media cyclone 20 depends on the actual mineral separation being effected within the cyclone 20. For the treatment of fine coal, ultra fine magnetite is typically used, for example having from 95%-99% of particles below 53 micron Typically, the cyclone according to the invention will have a diameter in the range of 100 mm-350 mm. By the term "cyclone diameter" is meant the diameter of the cyclone body 21 at the upper end 35 of the upper wall portion. Numerical experimental and pilot plant cyclones typically have a diameter of 350 mm.

Generally, in a 350 mm diameter cyclone the total length is 1.2 m, which equates to 3.5 Dc. These sorts of cyclones are suitable for fine particle separation where there is a high content of near gravity materials due t their inherently high residence time of neutrally buoyant particles.

Experimental Result

In these comparative tests, a DSM (Dutch State Mine) cyclone was tested against the CFD dense media cyclone of the invention.

A virtual test cyclone of 350 mm diameter, with an angle 20 degree slanted to the horizontal plane and a dense medium made of ultra fine quality was used for the simulations. The feed pressure to the cyclone used in simulations was in the rage of 1 to 1.5 meter which is 9 to 13 times the cyclone diameter. The predicted overflow and under flow of the cyclone were noted and used for the calculation of product densities.

At the end of each completed case. The turbulence analysis has been done before coal particle tracking process, to understand the flow structure and swirling patterns inside the cyclone.

After each test case had been completed, the partition characteristics of the DMC were modeled using Lagrangian particle tracking for particles ranging in size from 0.25 to 2 mm. Partition numbers were calculated according to techniques well known in the art.

The partition number (or coefficient) is basically an empirical measure of the average probability of the particles in the respective density fraction reporting to one or other of the products, for example to the cyclone underflow. The partition curve describes the partition number as a function of the particle densities. The efficiency of separation for a dense medium cyclone is usually represented by the Ep value, which is calculated as follow $$E_p=(D_{75}-D_{25})/2$$

Where $D_{75}$ is the density at which the probability of reporting to the underflow is 75%, and $D_{25}$ is the density at which the probability of reporting to the underflow is 25%.

Figure 6:
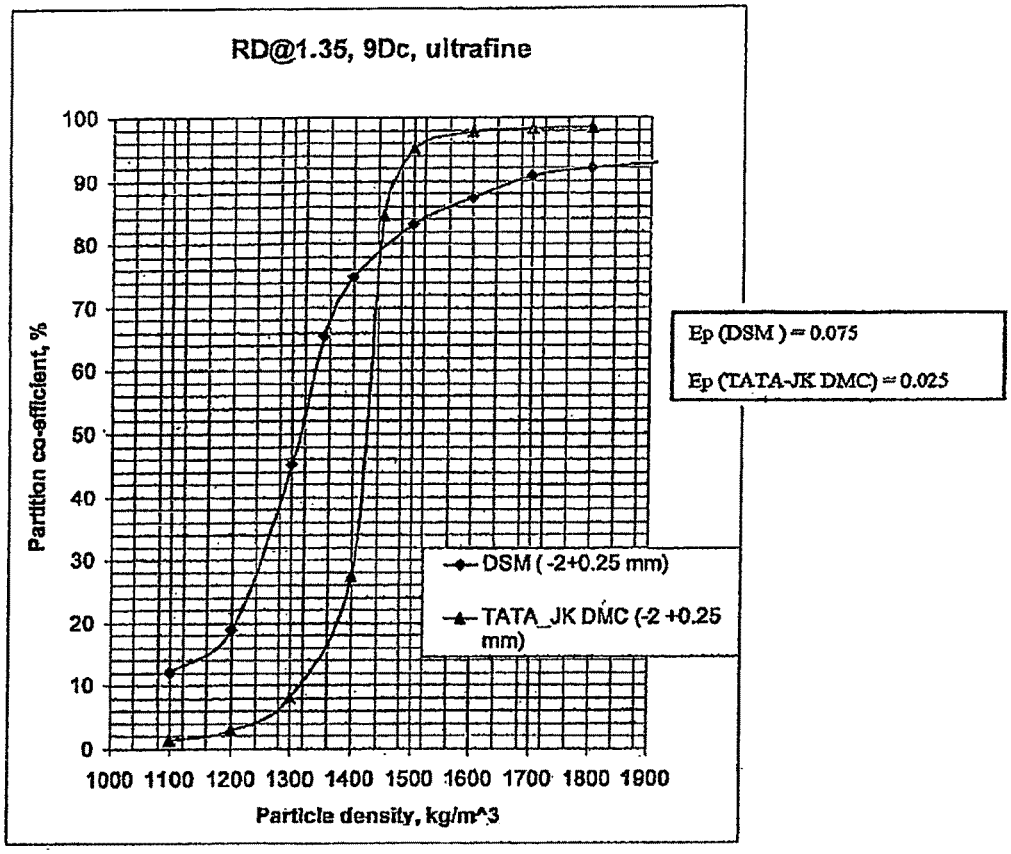
FIG. 6 is another graph of the predicted comparative performance of prior art cyclones and the cyclone illustrated in FIGS. 2A and 2B.

The steeper the partition curve, or the smaller the Ep value, the better the separation. The partition curves for the experiments conducted are shown in FIG. 6.

The numerical experiments clearly demonstrate that the CFD cyclone delivers superior performance to the DSM cyclone.

Figure 4:
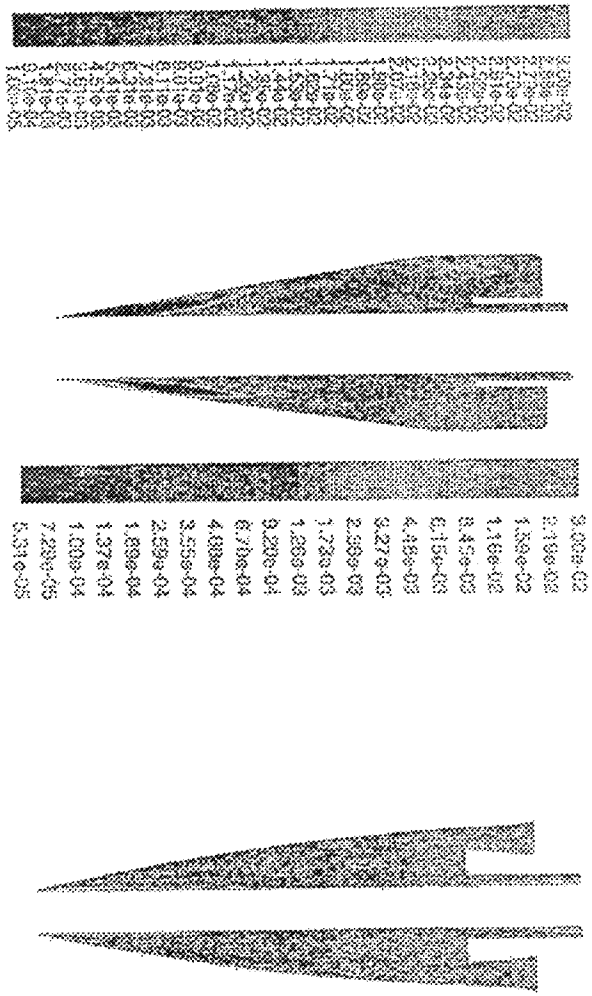
FIG. 4 is a graph of the predicted comparative turbulent kinetic energy of prior art cyclones and the illustrated in FIGS. 2A and 2B.

According to CFD predictions, as shown in FIG. 4, it is interesting to note that in the conventional dense medium cyclone a very high turbulent kinetic energy exists near the tip of vortex finer. As expected, the sudden transition from the cylindrical body to the conical section is a clear source of turbulent fluctuations down the cyclone body. These fluctuations usually propagate a very high turbulent kinetic energy near the bottom of the apex zone. Modifying the cylindrical-conical shape to a curved wall design minimizes the turbulent fluctuation due to separation at the intersection of cylindrical-conical body. Further, the throughput is high in this conceptual design compared with the conventional cyclones.

Certain embodiments of the CFD cyclone further provides an extended barrel length up to 3.25-3.5 Dc and this extended section mostly merged with rounded wall cyclone section. This arrangement provided an extra space for handling higher throughput compared to the convention cyclone.

Also according to embodiments of the CFD cyclone there may be included an outside tapered (9 degrees) thick vortex finder. With improved inlet chamber design conceptually it is possible to minimize the short-circuiting of high gravity fraction into overflow. Further, this vortex finder design provides high centrifugal forces.

Figure 5:
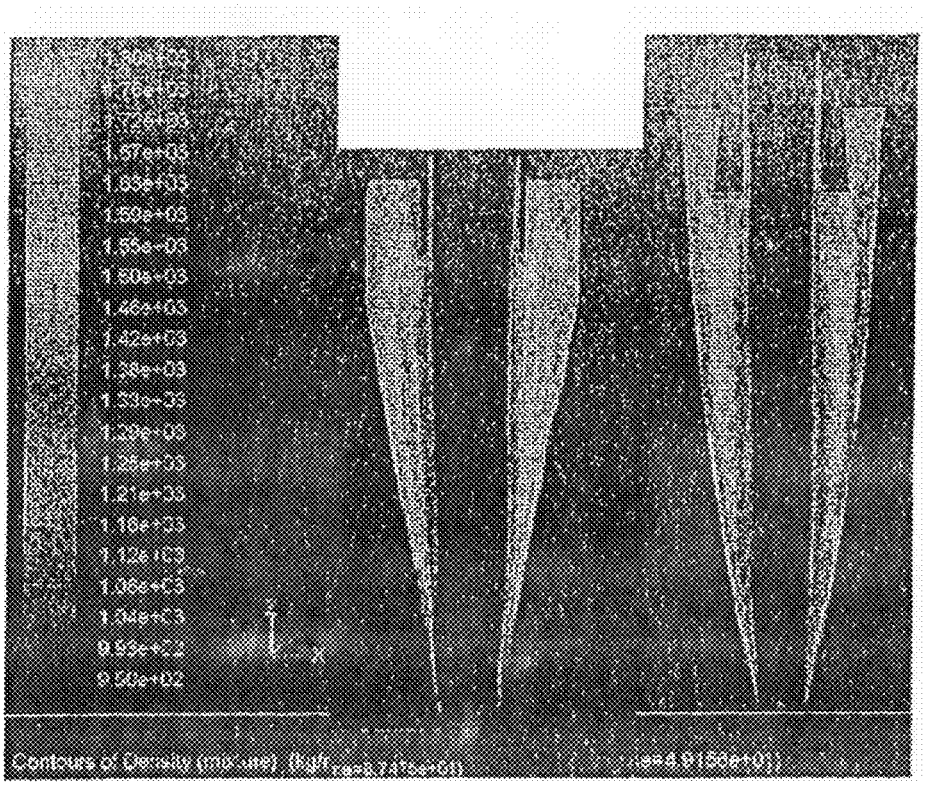
FIG. 5 is a graph of the predicted comparative density contours of prior art cyclones and the cyclone illustrated in FIGS. 2A and 2B.

The CFD predictions indicate that magnetic segregation is very significant in the conventional DSM cyclone compared to the CFD cyclone, as shown in FIG. 5. Unlike the conventional DSM cyclone, an almost uniform radial segregation of magnetic can be observed in the CFD cyclone. Hence the low density differential between overflow and underflows as provided in the table below.

TABLE 1

| Cyclone design | Feed density, Kg/m^3 | Underflow Density, kg/m^3 | Feed density, Kg/m^3 | Density differential kg/m^3 |
|---|---|---|---|---|
| DSM | 1352 | 1762 | 1081 | 681 |
| CFD | 1350 | 1580 | 1308 | 272 |

It is observed that the CFD cyclone is able to separate fine coal particles (−2+0.25 mm) more sharply than conventional DSM design, with reference to FIG. 6. A significant improvement in minimizing the short-circuiting to overflow observed in new design. Overall performance of the CFD cyclone design is much improved for the fine coal fraction compared to DSM design. This was attributed to minimization of turbulent fluctuations, flow reversals and short-circuiting flow.

The CFD cyclone design produced a lower Ep and therefore a higher efficiency that the DSM design. The increase in efficiency was particularly pronounced for very fine particles (0.5 mm 0.25 mm). The lower density difference between overflow and underflow for the CFD cyclone indicates that uniform magnetite segregation is being generated inside the cyclone.

Dense medium cyclone play a critical role in the beneficiation of coals. Any increase in Separation efficiency of the equipment employed will avoid loss of coal particles in rejects. The CFD cyclone design is expected to increase the cyclone efficiency and thereby increase clean coal yields from washeries. The comparison of efficiency curve of the CFD cyclone design vis-a vis the conventional DSM design indicates a significant improvement in separation. Also, as the equipment is specially designed to treat intermediate size coal (−2+0.25 mm) separately it enables a decrease in the overall ash content in the clean coal from the washeries. The lower ash in clean coal and, hence, lower coke ash is expected blast furnace productivity quite significantly.

It will of course be realized that the above has been given only by way of illustrative example of the invention and that all such modification and variations thereto as would be apparent to those of skill in the art are deemed to fall within the broad scope and ambit of the invention as herein set forth.

We claim:

1. A cyclone for dense medium separation comprising:

an inverted conical shaped cyclone body which provides an interior space having an inner wall surface;

a vortex finder including a lower end that extends longitudinally into an upper region of the interior space of the cyclone body;

an overflow outlet associated with an upper end of the vortex finder;

a feed inlet that is in fluid communication with the upper region of the interior space of the cyclone body;

an outlet associated with a terminal end at a lower region of the interior space; and the inner wall surface of the interior space curves inwardly and downwardly with respect to a longitudinal axis of the cyclone from the upper region of the interior space to the outlet at the terminal end of the lower region of the interior space, wherein the degree of curvature of the inner wall surface of the interior space in a longitudinal direction along the longitudinal axis of the cyclone continuously increases from a lower end of the vortex finder to the outlet at the terminal end of the lower region of the interior space from 1 degree at the point immediately below the feed inlet to 20 degrees at the terminal end, wherein the feed inlet includes an involute conduit that extends around a portion of a circumference of an upper end of the cyclone body, wherein the involute conduit extends horizontally along the portion of the circumference of the upper end of the cyclone body and includes a rear wall that curves inwardly and that is coterminous with an inner wall surface of the upper end of the cyclone body, and wherein an inner area of the involute conduit decreases from a first end to a second end at the inner wall surface of the cyclone body such that a ratio of a diameter at the first end to a diameter at the second end is 2.25 to 2.50.

2. The cyclone as claimed in claim 1, wherein the degree of curvature of the inner wall surface of the interior space in the longitudinal direction continuously increases from a point immediately below the inlet to the outlet associated with the terminal end of the lower region of the interior space.

3. The cyclone as claimed in claim 1, wherein the vortex finder is provided with an outer surface that tapers outwardly into the upper region of the interior space along the longitudinal axis of the cyclone body.

4. The cyclone as claimed in claim 3, wherein the outer surface of the vortex finder tapers outwardly and downwardly at 9 degrees from the longitudinal axis of the cyclone body.

5. The cyclone as claimed in claim 4, wherein the overflow outlet is disposed on the upper end of the vortex finder and in alignment with the longitudinal axis of the cyclone body.

6. The cyclone as claimed in claim 1, wherein the upper region of the interior space is in the form of a substantially cylindrical barrel that extends up to 1.23 times a cyclone diameter from the top of the cyclone body and that merges with and into the curved inner wall surface of the interior space of the cyclone body.

7. The cyclone as claimed in claim 1, wherein the cylinder diameter is the diameter of the cyclone body at the upper end of the upper end portion and is in the range of 100 mm to 3.50 mm.

8. The cyclone as claimed in claim 1, where in the total length of the cyclone along the longitudinal axis is in the range of 1.2 m to 1.5 m.

9. The cyclone as claimed in claim 1, wherein a rapidly swirling core of air moves upwardly from the underflow outlet through a central region of the interior space towards the vortex finder from where it exits via the overflow outlet.

10. The cyclone as claimed in claim 1, wherein the cyclone is configured to achieve mineral separation in the range 95% to 99% for particles below 53 microns.

11. A cyclone for dense medium separation comprising:

an inverted conical shaped cyclone body which provides an interior space having an inner wall surface;

a vortex finder including a lower end that extends longitudinally into an upper region of the interior space of the cyclone body;

an overflow outlet associated with an upper end of the vortex finder;

a feed inlet having an involute conduit that is in fluid communication with the upper region of the interior space of the cyclone body, the involute conduit extending around a portion of a circumference of an upper end of the cyclone body;

an outlet associated with a terminal end at a lower region of the interior space; and the inner wall surface of the interior space curves inwardly and downwardly with respect to a longitudinal axis of the cyclone from the upper region of the interior space to a terminal end of the lower region of the interior space, wherein the degree of curvature of the inner wall surface of the interior space in a longitudinal direction along the longitudinal axis of the cyclone continuously increases from a lower end of the vortex finder to the lower region of the interior space from 1 degree at the point immediately below the feed inlet to 20 degrees at the terminal end, wherein the involute conduit extends horizontally along the portion of the circumference of the upper end of the cyclone body and includes a rear wall that curves inwardly and that is coterminous with an inner wall surface of the upper end of the cyclone body, and wherein an inner area of the involute conduit decreases from a first end to a second end at the inner wall surface of the cyclone body such that a ratio of a diameter at the first end to a diameter at the second end is 2.25 to 2.50.

* * * * *